US012091880B2

(12) United States Patent
Farmer

(10) Patent No.: US 12,091,880 B2
(45) Date of Patent: Sep. 17, 2024

(54) MAINTAINING WATER BARRIER ABOVE RISING WATER

(71) Applicant: Victor Paul Farmer, Norfolk, VA (US)

(72) Inventor: Victor Paul Farmer, Norfolk, VA (US)

( * ) Notice: Subject to any disclaimer, the term of this patent is extended or adjusted under 35 U.S.C. 154(b) by 0 days.

(21) Appl. No.: 17/703,120

(22) Filed: Mar. 24, 2022

(65) Prior Publication Data

US 2022/0325549 A1 Oct. 13, 2022

Related U.S. Application Data

(60) Provisional application No. 63/174,237, filed on Apr. 13, 2021.

(51) Int. Cl.
*E04H 9/14* (2006.01)
*E02D 31/02* (2006.01)

(52) U.S. Cl.
CPC ..... *E04H 9/145* (2013.01); *E02D 31/025* (2013.01)

(58) Field of Classification Search
CPC ..... E04H 9/145; E04H 4/10; E04H 4/106; E04H 4/00; E02D 31/025; E02D 31/002; E02D 31/004; E02D 31/006
USPC ..... 52/169.1, 169.8, 169.14, 169.7, 741.4; 405/53, 63, 75, 270
See application file for complete search history.

(56) References Cited

U.S. PATENT DOCUMENTS 3,815,367 A * 6/1974 Collins ..... E04H 4/10 4/503
4,096,700 A * 6/1978 Muramatsu ..... E02B 15/06 405/63
4,610,794 A * 9/1986 Tsahalis ..... E02B 15/106 210/776
5,265,976 A * 11/1993 Russell ..... E04H 4/106 405/63
5,347,949 A * 9/1994 Winston ..... E02B 3/064 52/169.9
5,647,693 A * 7/1997 Carlinsky ..... E02D 5/00 52/169.9
5,904,446 A * 5/1999 Carlinsky ..... E02D 27/32 52/169.9
6,202,355 B1 * 3/2001 Uram ..... E04H 4/082 52/5
6,425,213 B1 * 7/2002 Lachapelle ..... E04H 9/145 52/409
6,558,548 B2 * 5/2003 Svirklys ..... B01D 53/02 210/603
6,575,666 B1 * 6/2003 Janesky ..... E02D 31/02 405/270

(Continued)

*Primary Examiner* — Brian E Glessner
*Assistant Examiner* — Adam G Barlow
(74) *Attorney, Agent, or Firm* — HOLLOWELL PATENT GROUP; Kelly J. Hollowell

(57) ABSTRACT

An arrangement for causing a water impermeable barrier conventionally lain on a ground surface to float above rising water or flooding, rather than being entrapped above the barrier, is shown and described. This invention applies particularly to ground coverings in building crawl spaces. In an embodiment, one or more floats are placed below the water impermeable barrier and above the ground. When flood waters recede, the float(s) and the water impermeable barrier return to their preflood locations above the ground surface. Floats may comprise blocks, sheets, strips, and other configurations of closed cell polymeric foam, for example. The float or floats may be coupled to the water impermeable barrier or alternatively, may be left decoupled therefrom.

16 Claims, 2 Drawing Sheets

(56) References Cited

U.S. PATENT DOCUMENTS 6,926,469 B2 * 8/2005 Janesky ..... E02D 31/02 405/270
6,932,540 B2 * 8/2005 Svirklys ..... C02F 3/2806 405/63
7,056,059 B1 * 6/2006 Wong ..... E02B 15/0842 405/63
7,735,271 B1 * 6/2010 Shipston ..... B32B 27/32 52/409
7,856,767 B2 * 12/2010 Janesky ..... E02D 31/02 405/270
8,007,205 B2 * 8/2011 Marshall, III ..... E02D 31/02 52/169.14
8,720,145 B2 * 5/2014 Marshall, III ..... E04B 1/62 52/411
8,844,455 B2 * 9/2014 Alshaikh ..... B65D 88/36 112/475.08
2004/0136790 A1 * 7/2004 Janesky ..... E02D 31/02 405/268
2005/0210772 A1 * 9/2005 Janesky ..... E02D 31/02 52/168
2007/0157533 A1 * 7/2007 Janesky ..... E02D 31/008 52/169.14
2007/0175112 A1 * 8/2007 Janesky ..... E02D 31/002 52/169.5
2007/0204530 A1 * 9/2007 Janesky ..... E02D 19/00 49/465
2007/0224003 A1 * 9/2007 Janesky ..... E04B 1/665 405/270
2008/0120771 A1 * 5/2008 Rayner ..... E04H 4/10 4/498
2013/0125481 A1 * 5/2013 Marshall ..... E04B 1/62 52/169.14
2015/0197909 A1 * 7/2015 Huh ..... E02D 3/123 405/270

* cited by examiner

MAINTAINING WATER BARRIER ABOVE RISING WATER

RELATED APPLICATIONS

This application claims priority in accordance with 37 CF.R. ¶ 1.19(e) to U.S. Provisional Patent Application Ser. No. 63/174,237 filed for MAINTAINING WATER BARRIER ABOVE RISING WATER filed Apr. 13, 2021 which is included herein in its entirety by reference.

FIELD OF THE INVENTION

The present invention relates to buildings, and more particularly, to an arrangement providing for preventing a water impermeable barrier placed on a ground surface of a lowermost space within a building from being covered by flood water.

BACKGROUND OF THE INVENTION

Spaces adjacent the ground of buildings, such as crawl spaces, are typically provided with a water impermeable barrier to prevent objectionable humidity arising from ground water from building up in the space. Such barriers may comprise sheets of plastic, such as polyethylene, for example. For buildings susceptible to infiltration of water through the ground, water level may rise temporarily during a rain or flood event. Should such water accumulate above the water impermeable barrier, return of that water into the ground could be slowed or prevented. Also, mud and other contaminants could be transported onto the upwardly facing surface of the barrier, and act as a reservoir retaining water and promoting humidity in the otherwise protected space.

There exists a need to overcome tendency of flood waters from being entrapped above a water impermeable barrier located over ground surfaces below buildings.

SUMMARY OF THE INVENTION

The present invention addresses the above need by causing a water impermeable barrier to float above flood water rather than be entrapped above the barrier.

To this end, one or more floats are placed below the water impermeable barrier and above the ground. When flood waters recede, the float(s) and the water impermeable barrier return to their preflood locations above the ground surface.

A float or floats may comprise blocks, sheets, strips, and other configurations of closed cell polymeric foam, for example. The float or floats may be coupled to the water impermeable barrier or alternatively, may be left decoupled therefrom.

The present invention provides improved elements and arrangements thereof by apparatus for the purposes described which is inexpensive, dependable, and fully effective in accomplishing its intended purposes.

These and other objects of the present invention will become readily apparent upon further review of the following specification and drawings.

BRIEF DESCRIPTION OF THE DRAWINGS

Various objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION

Figure 2:
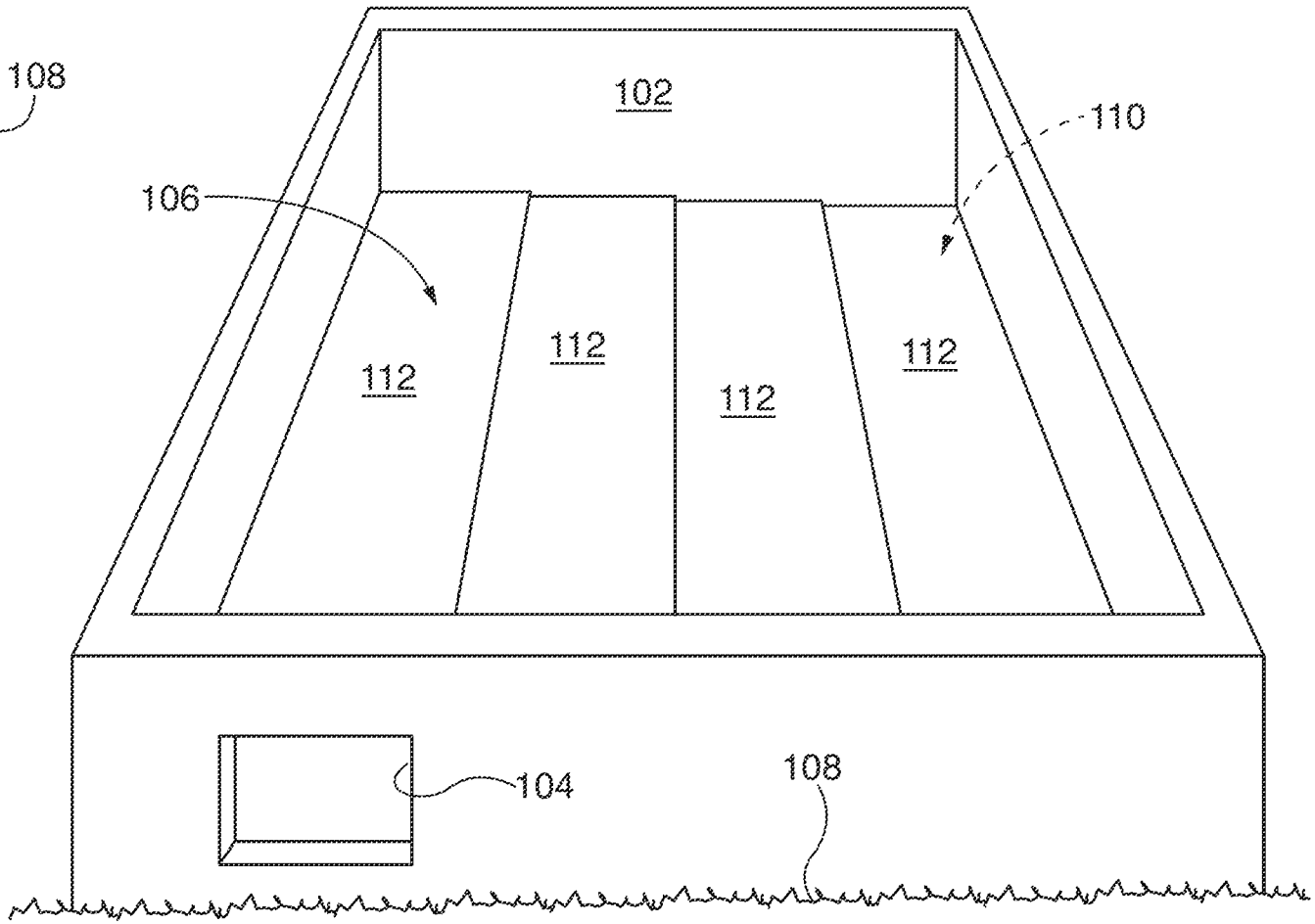
FIG. 2 is a perspective detail view of a foundation and enclosed crawl space of the house of FIG. 1.
Figure 1:
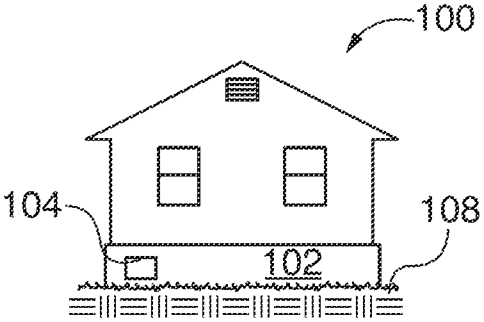
FIG. 1 is an end elevational view of a house built on solid ground.

Referring first to FIGS. 1 and 2, according to at least one aspect of the invention, there is shown a building 100 including a foundation 102. Foundation 102 includes an opening 104 affording access to a crawl space 106 (see FIG. 2) enclosed within foundation 102, below house 100, and above ground 108. Because most houses have lawns, ground 108 is depicted as having grass growing thereon, but will be understood to underlie the grass. Ground 108 may be at the same level within crawl space 106 as ground 108 is outside foundation 102. Alternatively, ground 108 may be higher or lower than ground 108 outside foundation 102. Regardless of relative elevation of ground 108 within foundation 102, ground 108 will be understood to present an upper surface (called out as 110 in FIG. 2, but not visible below sheets of polyethylene 112).

Sheets of polyethylene 112 provide a water impermeable barrier covering upper surface 110 of ground 108. This reflects conventional practice in crawl spaces (e.g., crawl space 106) of buildings built on moist soils, limiting ingress of objectionable humidity into crawl space 106. In summary, a building (house 100) having crawl space 106 above upper ground surface 110 of crawl space 106 is prepared for occupancy and use of the building in a location susceptible to flooding of the crawl space. The building may comprise foundation 102 supported in natural ground 108 and surrounding upper ground surface 110 of crawl space 106. Foundation 102 includes at least one opening 104 enabling fluid communication between crawl space 106 and an exterior of foundation 102. The building is above crawl space 106 and supported on foundation 102. The building includes a water impermeable barrier (in the example of FIGS. 1 and 2, sheets of polyethylene 112) of density less than a density of flood water. The water impermeable barrier is located between the building and upper ground surface 110.

The building also includes means for maintaining the water impermeable barrier above flood water (not shown) when the flood water is in crawl space 106.

It should be noted at this point that orientational terms such as above, below, higher, lower, upper, rising, beneath, and possibly others refer to the subject drawing as viewed by an observer. The drawing figures depict their subject matter in orientations of normal use, which could obviously change with changes in posture and position of the novel floats, with or without corresponding changes in an associated water impermeable barrier. The term "on" should not be assumed to imply a superior position or location. For example, an element supported on foundation 102 may be coupled to a lateral surface of foundation 102. Therefore, orientational terms must be understood to provide semantic basis for purposes of description, and do not limit the invention or its component parts in any particular way.

The water impermeable barrier may comprise a polymeric web (e.g., one or more sheets of polyethylene 112). Of course, the water impermeable barrier may take other forms, such as water proofed fabrics, metallic sheets or foils, or any combination of any of these. The water impermeable barrier rests on ground 108, and may be upwardly displaced by rising flood waters. That is, the water permeable barrier is fastened to the building or any of its components. Rising flood waters may migrate past the water permeable barrier, as often happens during floods. The water permeable barrier may then prevent flood waters to pass into the ground as the flood recedes.

Figure 3:
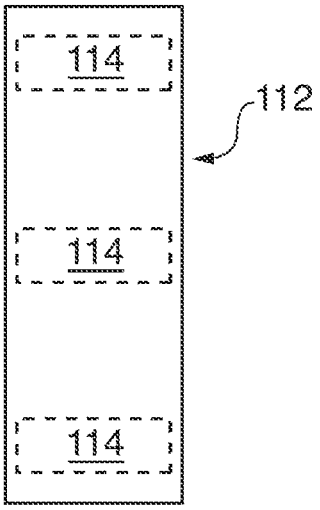
FIG. 3 is a top plan detail view of a strip of polyethylene sheet, as shown in FIG. 2.
Figure 4:
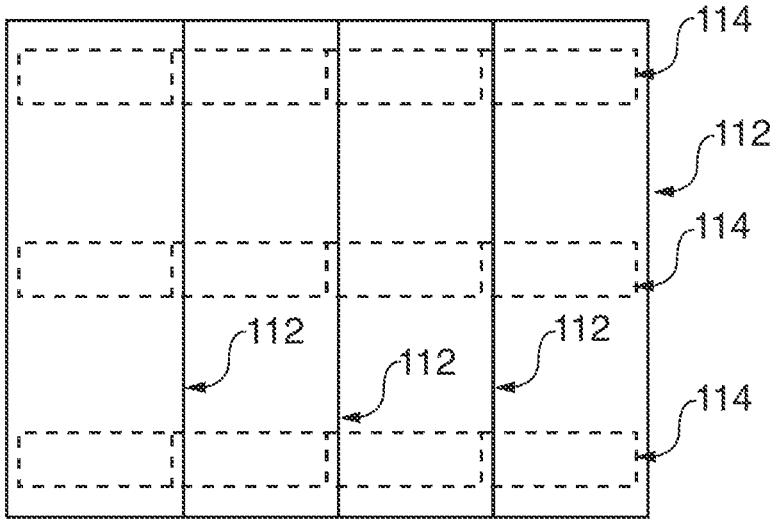
FIG. 4 is a top plan detail view of an alternative embodiment, showing elongated floats spanning plural strips of polyethylene sheet.

Referring also to FIG. 3, the means for maintaining the water impermeable barrier above the flood water may comprise at least one float 114. In the example of FIG. 3, three floats 114 are placed below sheet of polyethylene 112, spaced apart along a length of the latter. FIG. 4 shows an alternative embodiment wherein floats 114 are sufficiently elongated as to span plural sheets of polyethylene 112.

Figure 5:
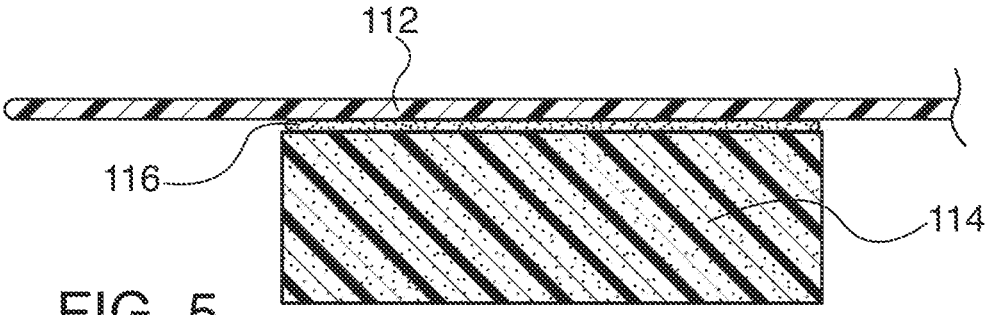
FIG. 5 is an enlarged side elevational detail view of a float coupled to an impermeable water barrier, the float and water impermeable barrier as illustrated in FIGS. 3 and 4.
Figure 6:
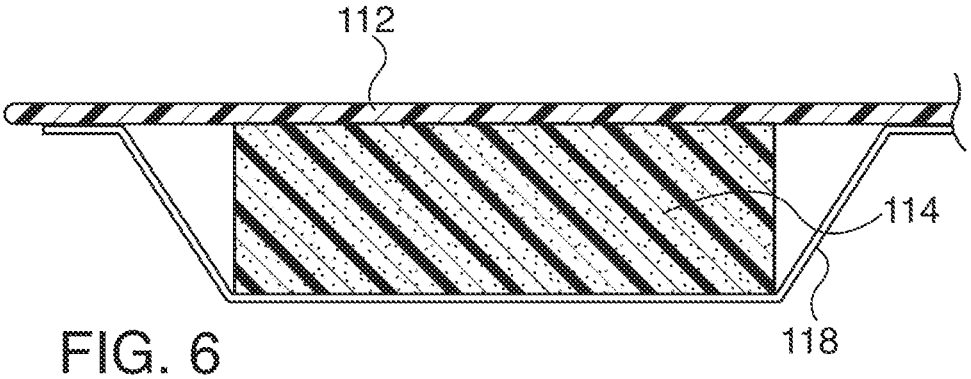
FIG. 6 is an enlarged side elevational detail view of a float coupled in a different way to a water impermeable barrier, the float and the water impermeable barrier as illustrated in FIGS. 3 and 4.

Turning to FIG. 5, float 114 is coupled to the water impermeable barrier by adhesive 116. In FIG. 6, float 114 is coupled to the water impermeable barrier by tape 118. Other ways of coupling float 114 to the water impermeable barriers may be utilized, such as snap fasteners, hook and loop fastener, clips, and others (none shown).

It is also possible that at least one float 114 be uncoupled to the water impermeable barrier. Usually, leaving floats 114 uncoupled may be done where floats 114 are large enough to resist being displaced to the point that part of a sheet of polyethylene 112 (or other water impermeable barrier) is no longer appropriately supported on float 114, and can drop into or beneath flood waters. This situation is not shown. Uncoupled floats 114 are illustrated in FIGS. 3 and 4.

At least one float 114 may comprise a closed cell polymeric foam (e.g., such as polystyrene float 114 in FIGS. 5 and 6). Of course, and as shown in FIGS. 3 and 4, the means for maintaining the water impermeable barrier above the flood water may comprise a plurality of floats 114. In this case, each one of the plurality of floats 114 may comprise the closed cell polymeric foam.

It is possible that at least one of the plurality of floats 114 be coupled to the water impermeable barrier, with others not so coupled. For example, one float 114 could be an elongated wooden pole coupled to the water impermeable barrier at and along a length of the latter. A permanently coupled float may then also serve to assist in transporting and maneuvering the water impermeable barrier, with additional floats 114 set in place after the water impermeable barrier has been set in place. This may be done where the water impermeable barrier occupies an irregular space, so that setting of additional floats 114 could be decided on depending on configuration of the water impermeable barrier.

At least one of the plurality of floats 114 may be uncoupled to the water impermeable barrier.

The means for maintaining the water impermeable barrier above flood water may of course be other than float(s) 114. In various examples, the means for maintaining the water impermeable barrier above flood water may comprise a flexible or rigid frame beneath the water impermeable barrier combined with a system to lift the flexible or rigid frame. Alternatively, edges or peripheral areas of the water impermeable barrier may be coupled to a system for lifting. Lifting systems may utilize electrical power, pneumatics, hydraulics, springs, mechanical connections to an internal combustion engine or other source of powered lifting motions, or may be provided with a mechanical linkage to enable manual power to be utilized.

In further examples, vacuum could be applied to the water impermeable barrier to engage the latter, to lift the latter, or both. Screw jacks and other lifting devices resting on the ground could be employed. Lifting systems could be supported on the foundation walls.

The invention may also be considered as a method of preparing crawl space 106 of a building (e.g., house 100) for occupancy and use of the building in locations susceptible to flooding. The method may comprise steps of covering an upper ground surface (e.g., ground surface 110) of crawl space 106 with a water impermeable barrier of density less than a density of flood water, and causing the water impermeable barrier to remain above the flood water when the flood water is in crawl space 106.

In the method, the step of causing the water impermeable barrier to remain above the flood water when the flood water is present may further comprise locating a plurality of floats (e.g., floats 114) between the upper ground surface and the water impermeable barrier, whereby the barrier will be induced to float when the flood water covers the upper ground surface.

The method may comprise a further step of coupling at least one of the plurality of floats (e.g., floats 114) to the water impermeable barrier.

The method may further comprise a further step of coupling all of the plurality of floats (e.g., floats 114) to the water impermeable barrier.

The method may comprise a further step of leaving at least one of the plurality of floats (e.g., floats 114) uncoupled to the water impermeable barrier and located beneath the water impermeable barrier.

The method may comprise a further step of leaving all of the plurality of floats (e.g., floats 114) uncoupled to the water impermeable barrier and located beneath the water impermeable barrier.

While the present invention has been described in connection with what is considered the most practical and preferred embodiment, it is to be understood that the present invention is not to be limited to the disclosed arrangements, but is intended to cover various arrangements which are included within the spirit and scope of the broadest possible interpretation of the appended claims so as to encompass all modifications and equivalent arrangements which are possible.

I claim:

1. A method of preparing a crawl space of a building for occupancy and use of the building in locations susceptible to flooding, the method comprising the steps of:

covering an upper ground surface of the crawl space with a water impermeable barrier of density less than a density of flood water; and causing the water impermeable barrier to remain above the flood water when the flood water is in the crawl space by locating a plurality of floats between the upper ground surface and the water impermeable barrier, whereby the barrier will be induced to float when the flood water covers the upper ground surface.

2. The method of claim 1, comprising a further step of coupling at least one of the plurality of floats to the water impermeable barrier.

3. The method of claim 1, comprising a further step of coupling all of the plurality of floats to the water impermeable barrier.

4. The method of claim 1, comprising a further step of leaving at least one of the plurality of floats uncoupled to the water impermeable barrier and located beneath the water impermeable barrier.

5. The method of claim 1, comprising a further step of leaving all of the plurality of floats uncoupled to the water impermeable barrier and located beneath the water impermeable barrier.

6. A building having a crawl space above an upper ground surface of the crawl space, wherein the crawl space is prepared for occupancy and use of the building in a location susceptible to flooding of the crawl space, the building comprising:

a foundation supported in natural ground and surrounding an upper ground surface of the crawl space, the foundation including at least one opening enabling fluid communication between the crawl space and an exterior of the foundation;

a building above the crawl space and supported on the foundation;

a water impermeable barrier of density less than a density of flood water, the water impermeable barrier located between the building and the upper ground surface; and means for maintaining the water impermeable barrier above flood water when the flood water is in the crawl space.

7. The building of claim 6, wherein the water impermeable barrier comprises a polymeric web.

8. The building of claim 7, wherein the polymeric web comprises polyethylene.

9. The building of claim 6, wherein the means for maintaining the water impermeable barrier above the flood water comprises at least one float.

10. The building of claim 9, wherein the at least one float is coupled to the water impermeable barrier.

11. The building of claim 9, wherein the at least one float is uncoupled to the water impermeable barrier.

12. The building of claim 9, wherein the at least one float comprises a closed cell polymeric foam.

13. The building of claim 6, wherein the means for maintaining the water impermeable barrier above the flood water comprises a plurality of floats.

14. The building of claim 13, wherein each one of the plurality of floats comprises a closed cell polymeric foam.

15. The building of claim 12, wherein at least one of the plurality of floats is coupled to the water impermeable barrier.

16. The building of claim 12, wherein at least one of the plurality of floats is uncoupled to the water impermeable barrier.

* * * * *